US005974758A

United States Patent [19]

Pielmeier

[11] Patent Number: 5,974,758

[45] Date of Patent: Nov. 2, 1999

[54] REINFORCED CHAMBER WITH A HOLLOW CROSS SECTION

[75] Inventor: Günter Pielmeier, Bogen, Germany

[73] Assignee: Thyssen Polymer GmbH, Bogen, Germany

[21] Appl. No.: 08/748,930

[22] Filed: Nov. 14, 1996

[30] Foreign Application Priority Data

Nov. 14, 1995 [DE] Germany ..... 195 42 397
Dec. 19, 1995 [DE] Germany ..... 195 47 471

[51] Int. Cl.[6] ..... E06B 3/22; E04C 3/30

[52] U.S. Cl. ..... 52/656.2; 52/204.5; 52/730.3; 52/731.2; 49/501

[58] Field of Search ..... 52/204.5, 656.2, 52/656.4, 656.9, 204.597, 732.1, 731.2, 731.3, 734.1, 730.3, 730.4, 730.5, 773, 774, 775; 49/501, 504; 403/231, 401

[56] References Cited

U.S. PATENT DOCUMENTS

| | | | |
|---|---|---|---|
| 2,190,263 | 2/1940 | Gerland | 52/656.2 |
| 4,240,235 | 12/1980 | Nawa | 52/730.4 X |
| 4,894,973 | 1/1990 | Over | 52/730.6 |
| 4,977,722 | 12/1990 | Taylor | 52/656.2 X |
| 5,036,637 | 8/1991 | Biebuyck | 52/730.4 X |
| 5,289,659 | 3/1994 | Harrison | 49/501 |

FOREIGN PATENT DOCUMENTS

| | | | |
|---|---|---|---|
| 077412 | 4/1983 | European Pat. Off. | 52/204.5 |
| 0312646 | 4/1989 | European Pat. Off. . | |
| 0463405 | 1/1992 | European Pat. Off. . | |
| 2840656 | 3/1980 | Germany | 52/656.2 |
| 3231876 | 3/1984 | Germany | 52/204.5 |
| 2259934 | 3/1993 | United Kingdom | 52/204.5 |

*Primary Examiner*—Carl D. Friedman
*Assistant Examiner*—Winnie S. Vip
*Attorney, Agent, or Firm*—Kane, Dalsimer, Sullivan, Kurucz, Levy, Eisele and Richard, LLP

[57] ABSTRACT

The apparatus includes a hollow chamber, preferably made from a synthetic material, such as PVC or other plastic, with an insertable reinforcement piece suitable for connecting to window, door or other configurations, such as abutment and frame profiles. The reinforcement piece comprises a unitary rolled sheet metal with one or more screw channels within the reinforcement profile for a front face abutment screw connection. The reinforcement piece further includes at least one shank inwardly extending from the screw channel toward the opposite chamber wall. The reinforcement piece further includes a shank extending around the inner walls of the hollow chamber.

10 Claims, 4 Drawing Sheets

REINFORCED CHAMBER WITH A HOLLOW CROSS SECTION

This application claims priority of German Patent Applications 195 42 397.6 filed Nov. 14, 1995 and 195 47 471.6 filed Dec. 19, 1995, the disclosures of which are hereby incorporated by reference.

BACKGROUND OF THE INVENTION

1. Field of the Invention

This invention pertains to a reinforced chamber with a hollow cross section for windows, doors and similar structures.

2. Description of the Prior Art

In German Patent No. 87 14 076 (European Patent PS 0 312 646), a center support for synthetic window frames is disclosed, wherein the cross section of the insert includes two portions which are mirror images of each other and facing each other, each of which has the basic shape of a "U". The two portions are arranged with the base shanks abutting one another. Each base shank is provided with reinforcing fins extending in the longitudinal direction, spaced from each other and parallel to each other thereby forming two screw channels. The dimensions of the shank are chosen so that each portion of the insert can be inserted into the chamber with some "play". Screws are inserted into the screw channels to secure the portions tightly and eliminate the "play". Such an insert with two halves and with such a cross section which can be loosely inserted into the hollow chamber has a number of disadvantages. For example, the screw channels for the abutment screws are formed only after the two halves abut each other, that is, the reinforcing fins in the halves must form one upper and one lower screw channel, into which the screws can be inserted. However, if the height of the cross section of the hollow chamber has even minor dimensional variations, the reinforcing fins do not align exactly opposite each other and a screw channel is not formed. This requires additional installation effort to resolve this problem. Similarly, if the width of the cross section of the hollow chamber has even minor dimensional variations, the sections tilt and insertion of the screws is difficult. An additional disadvantage is that the sections with their head and foot groove, in order to be functional, must be supported on the inner wall of the cross section of the hollow chamber. After insertion of the screws, these grooves press into the plastic material which results in an inelastic deformation of the synthetic material and, eventually, in a loosening of the screws. Additionally, the assembly of the sections is cumbersome and time consuming. Moreover, in longer configurations, such an apparatus can tend to be noisy.

The chamber with a hollow cross section disclosed in German Patent No. PS 40 20 559 is equipped with a single reinforcement piece having a one-sided open screw channel and thereby eliminates many of the disadvantages of German Patent No. 87 14 076 discussed above, but is still disadvantageous in that external elements like metal fittings and the like cannot be connected to the reinforcement piece, which extends to about the center of the hollow chamber, but rather are connected to the wall (which is typically made of plastic or other synthetic material) of the hollow chamber. This causes a weak connection and stress on the wall.

OBJECTS AND SUMMARY OF THE INVENTION

It is therefore an object of this invention to provide a reinforced hollow chamber made, for example, from plastic or similar synthetic material, which can handle increased stress.

It is therefore a further object of this invention to provide a reinforced hollow chamber which is not deformed by temperature differentials.

It is therefore a still further object of this invention to provide a reinforced hollow chamber which allows external elements, such as metal fittings, to be securely attached to the reinforcement member.

These and other advantages are attained by providing a hollow chamber with a reinforcement piece made from an open or closed unitary piece of rolled sheet metal with one or more one-sided open channels which provide screw channels. These screw channels act as shanks of the reinforcement piece around the inner wall of the hollow chamber. As the screw channels are formed from the unitary rolled sheet metal which likewise forms the reinforcement piece, the following advantages are attained:

1. a higher resistance to stresses caused by wind or temperature differentials;

2. the ability to reinforce the hollow chamber to achieve very high moments of inertia in both the X and Y directions by moving the walls of the reinforcement piece away from a central location of the hollow chamber;

3. the ability to mount external elements to the hollow chamber and reinforcement piece securely thereby reducing the possibility that the walls of the hollow chamber, which are frequently made of synthetic material such as plastic, will be overly stressed, this is accomplished by the sheet metal of the reinforcement piece being arranged parallel to the outer or inner wall of the hollow chamber, so that the external elements may be mounted at any given location of the synthetic outer wall of the hollow chamber, since the elements are attached to the reinforcement piece;

4. because of the arrangement of the connecting channels, for example, the screw channels in the central area of the hollow chamber, T-abutments and cross-abutments can be formed;

5. high stability of the shape and accuracy of the size are achieved due to the one-piece construction of the reinforcement piece;

6. simple adjustment of the reinforcement piece as well as of the screw channels and the location of the hollow chamber as well as the requirements with respect to the mounting of external elements, stability, cross section, and variations in construction, etc.;

7. the possibility of material savings when constructing the hollow chamber in view of the high strength of the reinforcement piece, the simple cross sections of the hollow chamber surrounding the reinforcement piece, and the synthetic materials such as plastic used to form the hollow chamber.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
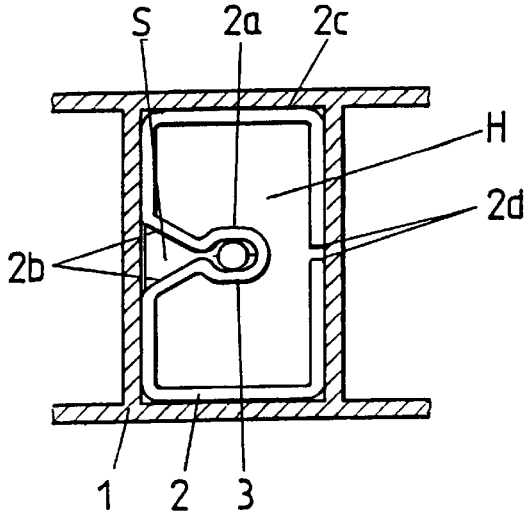
FIG. 1 is a cross-sectional view of the hollow chamber and the reinforcement piece of a first aspect the present invention.

Referring now to the drawings in detail, one sees that FIG. 1 is a cross-sectional view of rectangular hollow chamber H, formed by walls 1, typically of synthetic material such as plastic. Reinforcement piece 2, which is formed of a single unitary piece of rolled sheet metal, is inserted into hollow chamber H formed by walls 1. Reinforcement piece 2 includes a V-shaped slot S which opens toward one of the walls 1 and is formed by inwardly extending shanks 2*b*. Inwardly extending shanks 2*b* are integral with the reinforcement piece 2 and formed from the single unitary piece of rolled sheet metal. The apex of V-shaped slot S includes a bulbous portion which forms screw channel 2*a* which engages screw 3.

Figure 2:
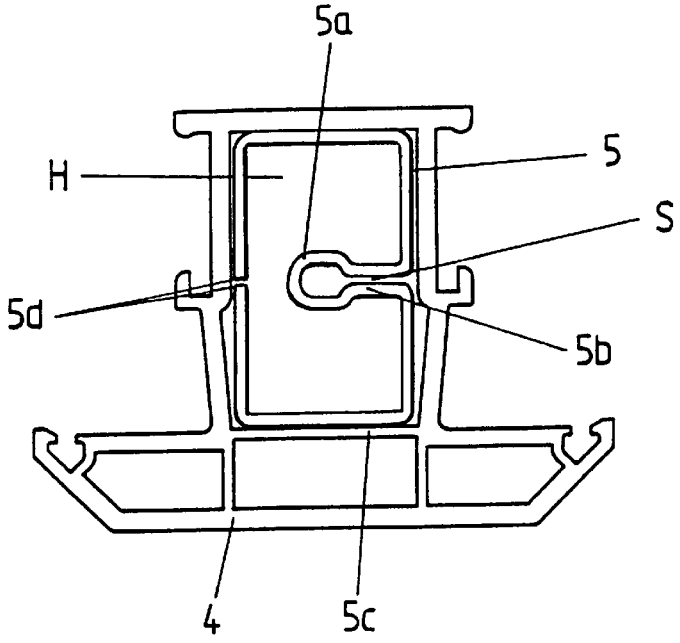
FIG. 2 is a cross-sectional view of the hollow chamber and the reinforcement piece of a second aspect of the present invention.

As shown in the aspect illustrated in FIG. 2, slot S can be small and defined by two parallel inwardly extending shanks 5*b*. The free shanks 2*c* from FIG. 1 or 5*c* from FIG. 2 project from inner wall of the hollow chamber walls 1 or 4. free shanks 2*c* or 5*c*, which are integral with inwardly extending shanks 2*b* or 5*b*, extend around the inner wall of the hollow chamber walls 1 or 4, so that the ends 2*d* or 5*d* of the free shanks 2*c* or 5*c* oppose each other thereby forming a gap adjacent to the hollow chamber wall 1 or 4 opposite from slot S. As shown in the lower part of FIG. 2, the reinforcement piece 5 does not necessarily extend parallel with the hollow chamber walls 4, but may extend at any given angle with respect to the walls 4 of the hollow chamber H. only two engagement points are necessary between the synthetic inner wall 4 and the reinforcement piece 5, therefore only minimal pressure is exerted on the engagement points so as to not inelastically deform the plastic. In addition to forming a gap, the ends 2*d* or 5*d* may be connected together, such as by welding, or may overlap.

Figure 4:
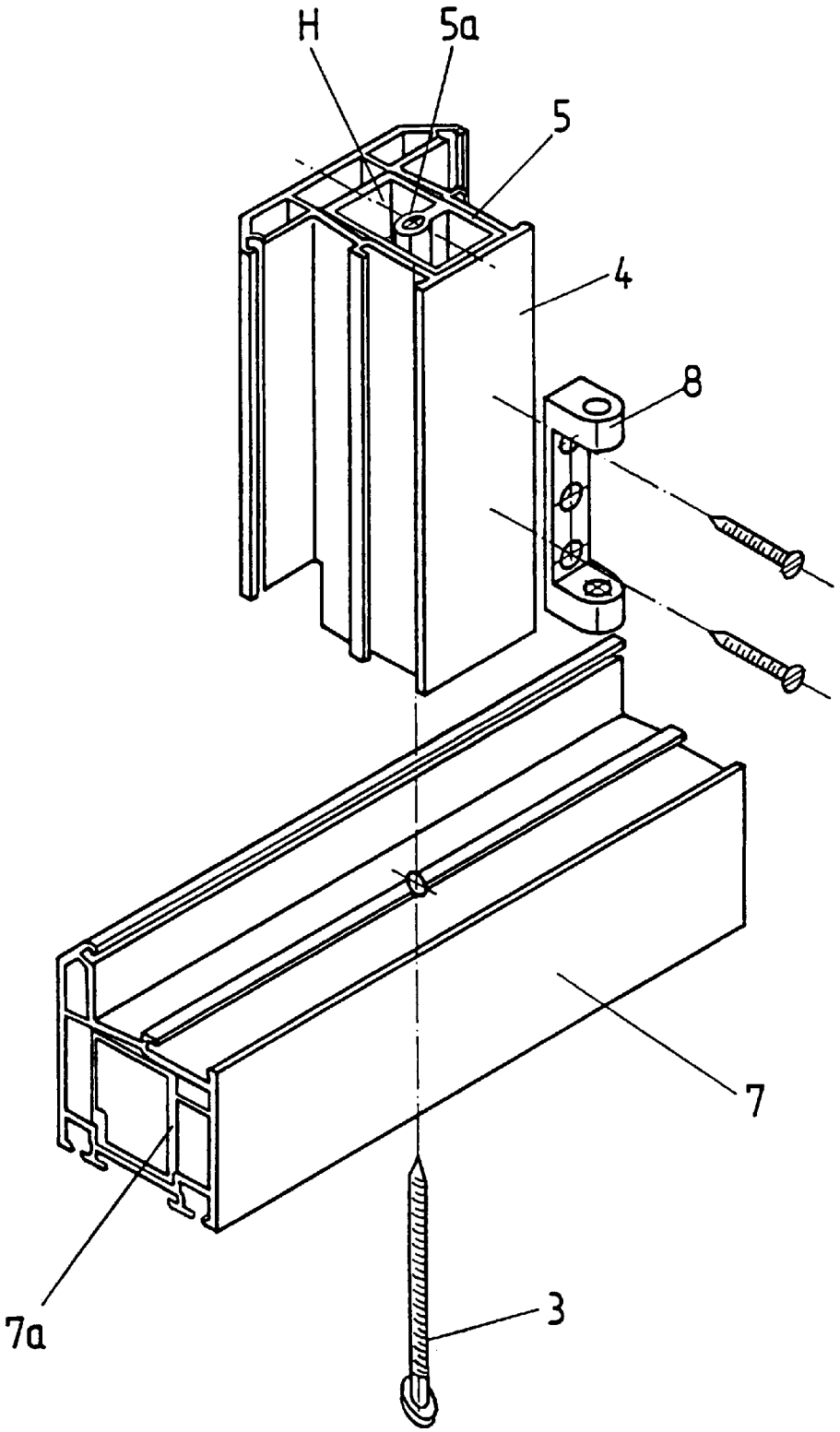
FIG. 4 is an exploded view of an application of the hollow chambers and reinforcement pieces of the present invention.

As shown in FIG. 1, a screw 3 (or other similar mounting apparatus) may be inserted into the bulbous portion of slot S which forms the screw channel 2*a*. Screw 3 is used to mount the front face connecting the reinforcement piece 5, for example as shown in FIG. 4, in a window or door. In such a configuration as is shown in FIG. 4, the hollow chamber walls 1 or 4 form a jam configuration for engaging another similar configuration, such as an abutment configuration 7. Additionally, as shown in FIG. 4, external elements 8 can be attached to hollow chamber wall 4 by screws which are engaged by reinforcement piece 5.

Figure 3:
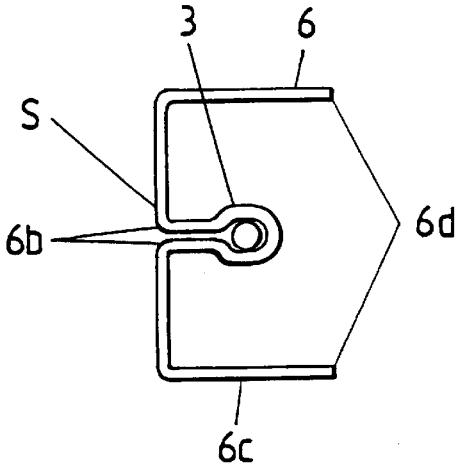
FIG. 3 is a cross-sectional view of an additional aspect of the reinforcement piece of the present invention.

FIG. 3 illustrates another aspect of reinforcement piece (illustrated as element 6). This reinforcement piece 6 has an E-shaped cross section with a central horizontal (in the illustrated orientation) portion formed by parallel inwardly extending shanks 6*b* forming slot S and upper and lower horizontal portions formed by free shanks 6*c*. The ends 6*d* of the reinforcement piece 6 are not oppositely adjacent to each other, but they are parallel as free shanks 6*c* which typically engage the corners of hollow chamber H.

FIG. 4, as discussed above, illustrates the connection of hollow chamber configuration 4 with hollow chamber configuration 7. Hollow chamber configuration 4 is, for instance, a support configuration, and hollow chamber configuration 7 is, for instance, a frame or abutment configuration. Hollow chamber configurations 4 and 7 are secured to each other by screw 3 which passes through hollow chamber configuration 7 and enters the screw channel 5*a* formed by inwardly extending shanks 5*b* of hollow chamber configuration 4. An external element 8, such as a fitting, is attached by a screw passing through the hollow chamber walls and reinforcement piece 5.

Figure 5:
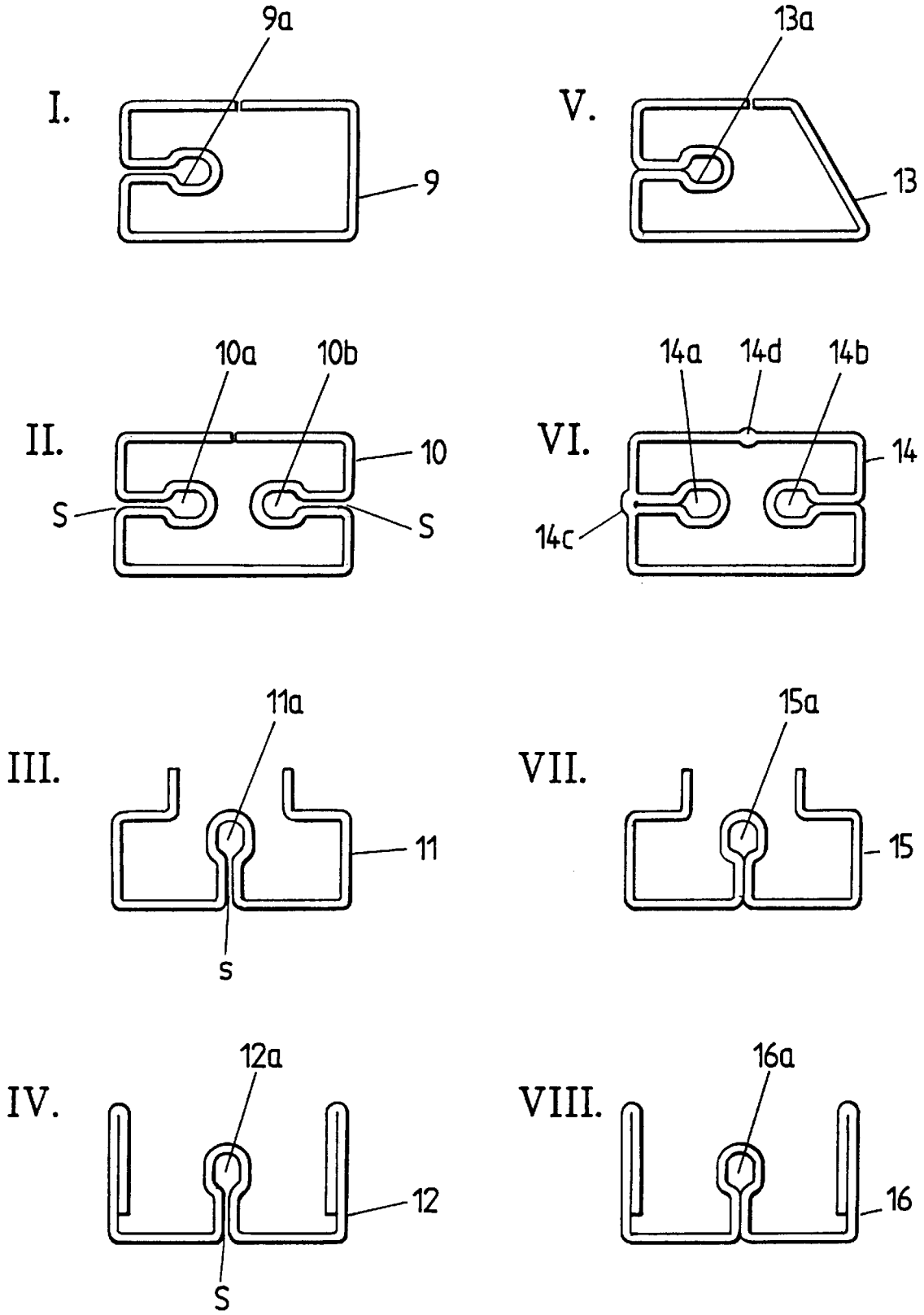
FIGS. 5-I through 5-VIII are cross-sectional views of still further additional aspects of the reinforcement piece of the present invention.

FIGS. 5-I through 5-VIII illustrate different aspects of reinforcement pieces 9–16, respectively. The shape of the reinforcement pieces 9–16 can be adapted to the given requirements without leaving the scope of the invention.

FIG. 5-I illustrates an aspect wherein slot S forming screw channel 9*a* extends from the shorter of the faces of hollow (rectangular) chamber H in accordance with FIG. 1. The cross section of reinforcement piece 9 is closed with the ends welded together, for example.

FIG. 5-II illustrates an aspect wherein reinforcement piece 10 includes two screw channels 10*a*, 10*b*.

FIG. 5-III illustrates an aspect wherein the sheet metal cross section of reinforcement piece 11 is adapted to a preformed non-rectangular shape of the hollow chamber. Reinforcement piece 11 likewise includes screw channel 11*a*.

FIG. 5-IV illustrates an aspect wherein the ends of free the shanks are folded back to achieve an increased stiffness of the shanks. Reinforcement piece 12 likewise includes screw channel 12*a*.

Figure 6:
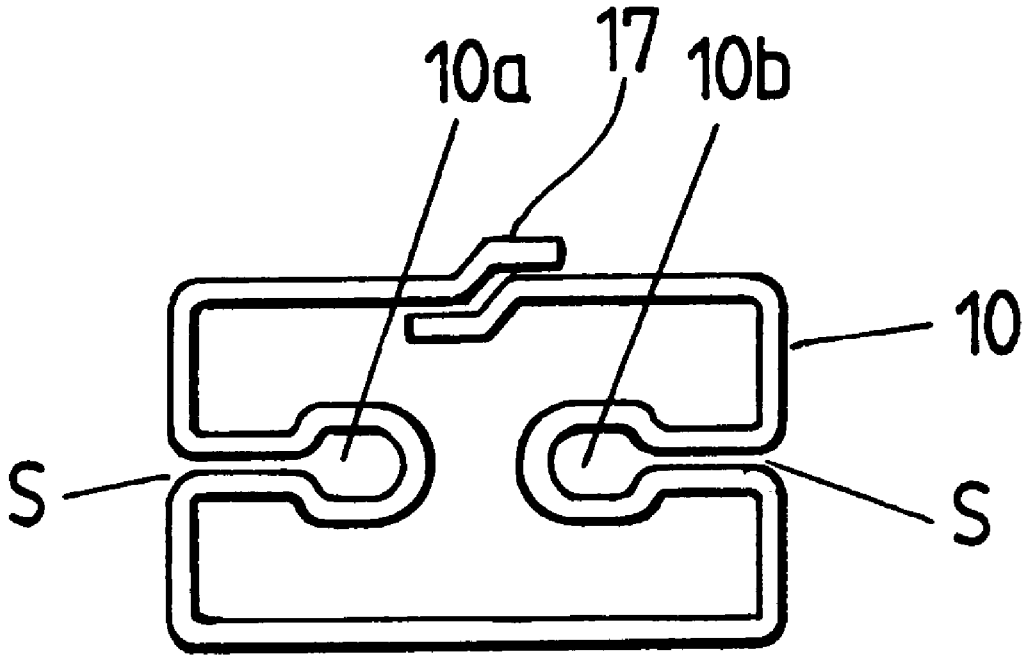
FIG. 6 is a cross-sectional view of an additional aspect of the reinforcement piece of the present invention.

FIG. 5-V through FIG. 5-VIII illustrate additional aspects of reinforcement pieces 13, 14, 15, 16 which substantially correspond to the aspects of the reinforcement pieces of FIG. 5-I through 5-IV, respectively, and additionally showing the shanks forming screw channels 13*a*, 14*a*, 14*b*, 15*a*, and 16*a* in a welded configuration. Additional weld seams 14*c* and 14*d* are shown in FIG. 5-VI in order to achieve additional rigidity. FIG. 6 is a cross-sectional view of the reinforcement piece 10 illustrated 5-II and illustrates an aspect wherein the ends of free shanks overlap to form a seam 17. It will be appreciated that the reinforcement piece 10 illustrated in FIG. 6 is merely exemplary of an overlapping seam 17.

Thus the several aforementioned objects and advantages are most effectively attained. Although preferred embodiments of the invention have been disclosed and described in detail herein, it should be understood that this invention is in no sense limited thereby and its scope is to be determined by that of the appended claims. For instance, while the disclosed embodiment shows the use of the invention for securing a jam component to an abutment component in a window frame, the invention may be used in other similar fields such as window frames in door frames, roofs, banisters, winter gardens, hothouses, halls, etc.

What is claimed is:

1. An apparatus comprising:

walls forming a hollow chamber;

a reinforcement piece formed from unitary rolled sheet metal and inserted into said hollow chamber, said reinforcement piece including:

at least one screw channel adapted for receiving a screw along a longitudinal direction thereof, each of said at least one screw channel being formed at a distal end of a single pair of inwardly extending shanks, and at least one free shank extending from at least one of said inwardly extending shanks along said walls.

2. The apparatus of claim 1 wherein said pair of inwardly extending shanks extend from said screw channel in a direction parallel to one of said walls.

3. The apparatus of claim 2 wherein said at least one free shank includes two free shanks with distal ends which oppose each other thereby forming a gap therebetween.

4. The apparatus of claim 2 wherein said at least one free shank includes two free shanks with distal ends which are parallel to each other along two parallel walls of said hollow chamber.

5. The apparatus of claim 2 wherein said at least one free shank includes two free shanks with distal ends which overlap each other.

6. The apparatus of claim 1 wherein said inwardly extending shanks are inclined so as to form a V-shape with an open end adjacent to one of said walls of said hollow chamber.

7. The apparatus of claim 1 wherein said inwardly extending shanks are parallel to each other.

8. The apparatus of claim 1 wherein said at least one free shank includes two free shanks with distal ends which are connected to each other.

9. The apparatus of claim 1 wherein said inwardly extending shanks are connected to each other.

10. The apparatus of claim 1 wherein said reinforcement piece is connected through one of said walls by an external element in at least one location of said reinforcement piece.

* * * * *